US006366754B1

(12) United States Patent
Sato et al.

(10) Patent No.: US 6,366,754 B1
(45) Date of Patent: Apr. 2, 2002

(54) COLOR IMAGE FORMING APPARATUS WITH TONER RECYCLING

(75) Inventors: Masumi Sato; Kazuhiko Yuuki, both of Kanagawa; Hiroshi Yoshinaga, Chiba; Yoshinori Ozawa; Atsushi Takehara, both of Kanagawa, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/667,501

(22) Filed: Sep. 22, 2000

(30) Foreign Application Priority Data

Sep. 22, 1999 (JP) ..... 11-268777

(51) Int. Cl.[7] ..... G03G 15/01
(52) U.S. Cl. ..... 399/223; 399/359; 430/45
(58) Field of Search ..... 399/359, 223, 399/299, 344; 430/42, 45

(56) References Cited

U.S. PATENT DOCUMENTS 5,296,877 A 3/1994 Sato
5,620,820 A * 4/1997 Bertrand et al. ..... 430/42
6,021,286 A * 2/2000 Kawai et al. ..... 399/299 X

FOREIGN PATENT DOCUMENTS

| | | |
|---|---|---|
| JP | 7-281484 | 10/1995 |
| JP | 9-244294 | 9/1997 |
| JP | 9-288397 | 11/1997 |
| JP | 10-282754 | * 10/1998 |

* cited by examiner

*Primary Examiner*—Joan Pendegrass
(74) *Attorney, Agent, or Firm*—Oblon, Spivak, McClelland, Maier & Neustadt, P.C.

(57) ABSTRACT

A color image forming apparatus includes a plurality of image forming sections independent of each other. The image forming sections store respective toner of different colors that are chargeable to the same polarity. All the toner are implemented by the same binder resin and provided with the same particle size distribution. Further, developing units each storing toner of particular color are identical in specification. When two-ingredient type developers are used, the developers contain an identical carrier. The apparatus recycles the toner of different colors to the respective developing units. The alien color toner collected in each developing unit is prevented from remaining by being chargeable to the same polarity.

32 Claims, 2 Drawing Sheets

COLOR IMAGE FORMING APPARATUS WITH TONER RECYCLING

CROSS-REFERENCE TO RELATED APPLICATIONS

This application is related to and claims priority, under 35 U.S.C, § 119, from Japanese Patent Application No. 11-268777, filed on Sep. 22, 1999, the entire contents of which are hereby incorporated by reference herein.

BACKGROUND OF THE INVENTION

1. Field of the Invention

The present invention relates to a copier, printer, facsimile apparatus or similar full-color image forming apparatus of the type developing latent images each being formed on a particular image carrier with developers of different colors to thereby produce a full-color image.

2. Discussion of Background

It is a common practice with an electrophotographic image forming apparatus to uniformly charge the surface of a photoconductive element, expose the charged surface imagewise in order to form a latent image, develop the latent image to thereby form a corresponding toner image, and transfer the toner image to a paper sheet or similar recording medium. A cleaning unit removes toner left on the photoconductive element after the image transfer so as to prepare the element for the next image formation. The toner removed by the cleaning unit is collected in the cleaning unit and then discarded. This, however, forces the operator of the apparatus to discard the collected toner every time it fills up a container, brings about pollution ascribable to the discarded toner, and obstructs the efficient use of the developer.

In light of the above, Japanese Patent Laid-Open Publication No. 56-21175, for example, proposes a toner recycling mechanism applicable to an image forming apparatus of the type using toner of a single color and constructed to return the toner collected by a cleaning unit to a developing unit, so that the toner can be reused. To promote the conveyance of residual toner and to enhance the durability of toner, Japanese Patent Laid-Open Publication Nos. 1-214874 and 2-110572 teach improved configurations of toner itself. Further, Japanese Patent Laid-Open Publication No. 2-157765 discloses a method of improving the particle size distribution of toner in relation to a dry two-ingredient type developer.

There is an increasing demand for full-color image forming apparatuses in parallel with the development of computers, color facsimile apparatus, color printers and so forth. As a result, the amount of collected toner is increasing. A problem with a full-color image forming apparatus is that it uses more toner than a monocolor image forming apparatus and therefore needs a larger container for storing collected toner. This, coupled with the fact that the toner contains harmful substances, has highlighted the necessity of toner recycling more for a full-color image forming apparatus than for a monocolor image forming apparatus.

When a conventional full-color image forming apparatus is, constructed to recycle toner, it has been customary to develop latent images formed on photoconductive elements with respective developing units, transfer the resulting toner images to a paper sheet or similar recording medium one above the other, remove toner left on the photoconductive elements with respective cleaners, and then collect the removed toner in a single container. This gives rise to a problem that the collected toner of different colors are mixed together in the container and cannot be reused for color development.

To solve the above-described problem, Japanese Patent Laid-Open Publication No. 9-288397, for example, discloses an arrangement including a plurality of photoconductive elements each being assigned to a particular color and a plurality of cleaning units each cooperating with one of the photoconductive elements. Toner left on each photoconductive element after image transfer is removed independently of the other toner and collected in a particular container. While this arrangement implements toner recycling in a full-color image forming apparatus, mixture of colors occurs in practice. Experiments showed that when a toner image of particular color formed on a downstream photoconductive element is transferred to a paper sheet, a toner image transferred from an upstream photoconductive element to the paper sheet is again partly transferred to the downstream photoconductive element and then introduced into a cleaning unit together with collected toner. Such inverse toner transfer and therefore the mixture of colors is not avoidable with the conventional apparatus.

Technologies relating to the present invention are also disclosed in, e.g., Japanese Patent Laid-Open Publication Nos. 7-281484 and 9-244294.

SUMMARY OF THE INVENTION

It is therefore an object of the present invention to provide a color image forming apparatus capable of insuring desirable image quality over a long period of time by recycling toner of different colors while reducing troubles ascribable to the mixture of the toner. A color image forming apparatus of the present invention sequentially transfers toner images each being formed on a particular image carrier to a recording medium one above the other to thereby form a color image, and reuses developers removed from image carriers. A plurality of developing units each are configured to store a developer implemented by a particular coloring agent for developing a latent image electrostatically formed on one of a plurality of image carriers with the developer. A plurality of cleaning units each are configured to remove the developer remaining on a particular image carrier and collect it. A plurality of toner recycling units each are configured to return the toner collected by a respective cleaning unit to a respective developing unit. The coloring agents of the developers are chargeable to the same polarity.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
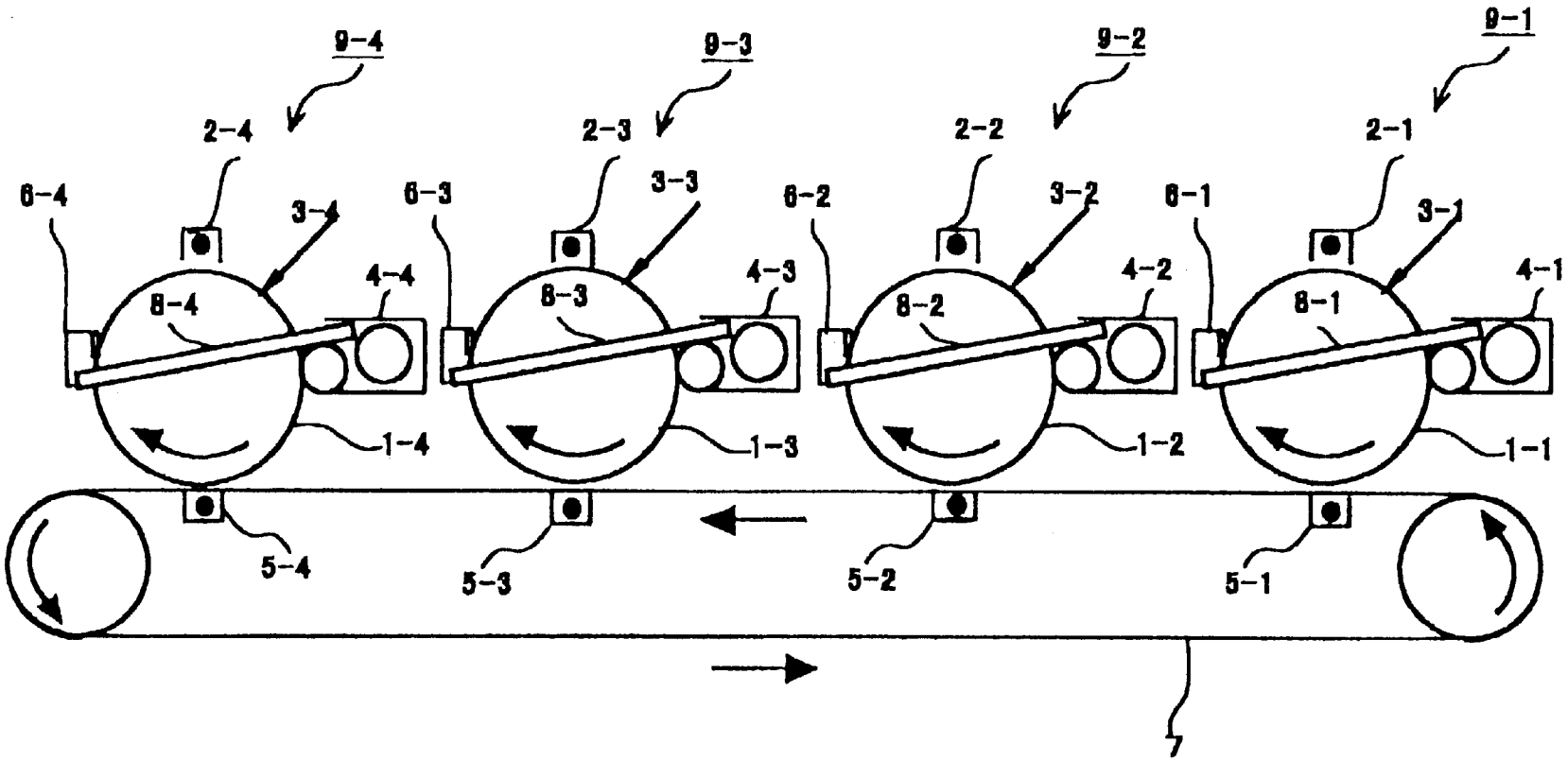
FIG. 1 is a view showing an image forming apparatus embodying the present invention and implemented as a full-color system.

Referring to FIG. 1 of the drawings, a color image forming apparatus embodying the present invention is shown and implemented as a full-color system using four photoconductive elements in the form of drums. As shown, the color image forming apparatus includes a first to a fourth independent image forming sections 9-1 to 9-4. The first image forming section 9-1 includes a photoconductive drum or image carrier 1-1. A charger 2-1, an exposing unit 3-1, a developing unit 4-1, an image transferring unit 5-1, a cleaning unit 6-1, and a recycling unit 8-1 are arranged around the drum 1-1. The charger 2-1 uniformly charges the surface of the drum 1-1. The exposing unit 3-1 exposes the charged surface of the drum 1-1 with color-separated image data to thereby form a latent image. The developing unit 4-1 develops the latent image with toner corresponding in color to the image data, thereby forming a corresponding toner image. The image transfer unit 5-1 transfers the toner image from the drum 1-1 to a paper sheet or similar recording medium. The cleaning unit 6-1 removes the toner left on the drum 1-1 after the image transfer. The recycling unit 8-1 returns the toner collected by the cleaning unit 6-1 to the developing unit 4-1.

The second to fourth image forming sections 9-2 to 9-4 are identical in configuration with the first image forming section 9-2 and respectively include photoconductive drums 1-2 to 1-4, chargers 2-2 to 2-4, exposing units 3-2 to 3-4, developing units 4-2 to 4-4, image transferring units 5-2 to 5-4, cleaning units 6-2 to 6-4, and recycling units 8-1 to 8-4.

A conveyor belt 7 is positioned below the drums 1-1 through 1-4 and movable in a direction indicated by an arrow in FIG. 1. The drums 1-1 through 1-4 are sequentially arranged in this order in the direction of movement of the conveyor belt 7. The image transferring units 5-1 through 5-4 respectively face the drums 1-1 through 1-4 via the conveyor belt 7. The drums 1-1 through 1-4 each are implemented by an OPC (Organic Photo Conductor) drum and rotatable in a direction indicated by an arrow in FIG. 1. The conveyor belt 7 is passed over two rollers, which are rotatable in a direction indicated by arrows, and conveys the paper sheet via image transfer positions where the image transferring units 5-1 through 5-4 are located.

The developing units 4-1 through 4-4 respectively store yellow or first-color toner Y, magenta or second-color toner M, cyan or third-color toner C, and black or fourth-color toner B. The developing units 4-1 through 4-4 each include a developing roller rotatable in the opposite direction to the drum 1 and a toner feed roller positioned behind the developing roller. The toner feed roller feeds the toner stored in the developing unit to the surface of the developing roller.

In operation, the chargers 2-1 through 2-4 uniformly charge the surfaces of the drums 1-1 through 1-4, respectively. The exposing units 3-1 through 3-4 respectively expose the charged surfaces of the drums 1-1 through 1-4 with respective color-separated image data, thereby electrostatically forming latent images. The drums 1-1 through 1-4 in rotation convey the latent images to developing regions where they face the developing units 4-1 through 4-4, respectively. In each of the developing units 4-1 through 4-4, the toner feed roller in rotation feeds the respective toner to the associated developing roller. The developing roller in rotation conveys the toner deposited thereon to the developing region. As a result, the toner is transferred from the developing roller to the latent image so as to produce a corresponding toner image.

The drums 1-1 through 1-4 convey the respective toner images to the image transfer positions where the image transferring units 5-1 through 5-4, respectively, are located. First, the toner image formed by the yellow toner image Y in the first image forming section 9-1 is transferred to the paper sheet being conveyed by the conveyor belt 7. Subsequently, while the conveyor belt 7 conveys the paper sheet, the toner images formed by the magenta toner M, cyan toner C and black toner B in the second, third and fourth image forming sections 9-2, 9-3 and 9-4, respectively, are sequentially transferred to the paper sheet one above the other, completing a full-color image. Thereafter, a fixing unit, not shown, fixes the toner image on the paper sheet.

After the image transfer, the drums 1-1 through 1-4 convey the toner left thereon to positions where the cleaning units 6-1 through 6-4, respectively, are located. A blade included in each of the cleaning units 6-1 through 6-4 contacts the associated drum and scrapes off the toner left on the drum. The toner removed from the drum is collected in the cleaning unit. The recycling units 8-1 through 8-4 respectively return the collected toner from the cleaning units 6-1 through 6-4 to the developing units 4-1 through 4-4. Consequently, each toner is mixed with fresh toner of the same color and again used for development.

In the illustrative embodiment, the image forming sections 9-1 through 9-4 are independent of each other. The cleaning units 6-1 through 6-4 therefore each collect the toner of particular color left on associated one of the drums 1-1 through 1-4. It follows that only the toner of particular color Y, M, C or B is expected to exist in each of the cleaning units 6-1 through 6-4. In practice, however, toner of different colors exist together in each cleaning unit.

Specifically, it was found that only the yellow toner existed in the cleaning unit 6-1 of the first image forming section 9-1. However, the yellow toner Y and magenta toner M existed in the cleaning unit 6-2 of the second image forming section 9-2. The yellow toner Y, magenta toner M and cyan toner C existed in the cleaning unit 6-3 of the third image forming unit 9-3. Further, the yellow toner Y, magenta toner M, cyan toner C and black toner B all existed in the cleaning unit 6-4 of the fourth image forming section 9-4. That is, in the cleaning unit of the N-th (N=1 through 4) image forming section, the toner of the N-th color and the toner of all colors preceding it existed together.

Experiments were conducted to find the cause of the mixture of colors occurring in the cleaning units 6-1 through 6-4. The experiments showed that when a toner image of particular color was transferred from each drum to the paper sheet, a toner image transferred to the paper sheet from the preceding or upstream drum was again partly transferred to the following or downstream drum and then introduced into the cleaning unit together with the collected toner. For example, at the time when the toner image formed by the magenta toner image M stored in the developing unit 4-2 is transferred from the drum 1-2 to a paper sheet, the toner image formed by the yellow toner Y by the first image forming section 9-1 exists on the paper sheet. As a result, the yellow toner image is again partly transferred from the paper sheet to the drum 1-2. Consequently, the yellow toner Y and magenta toner M are left on the drum 1-2 together after the image transfer. The cleaning unit 6-2 collects the mixture of such two kinds of toner from the drum 1-2.

Figure 2:
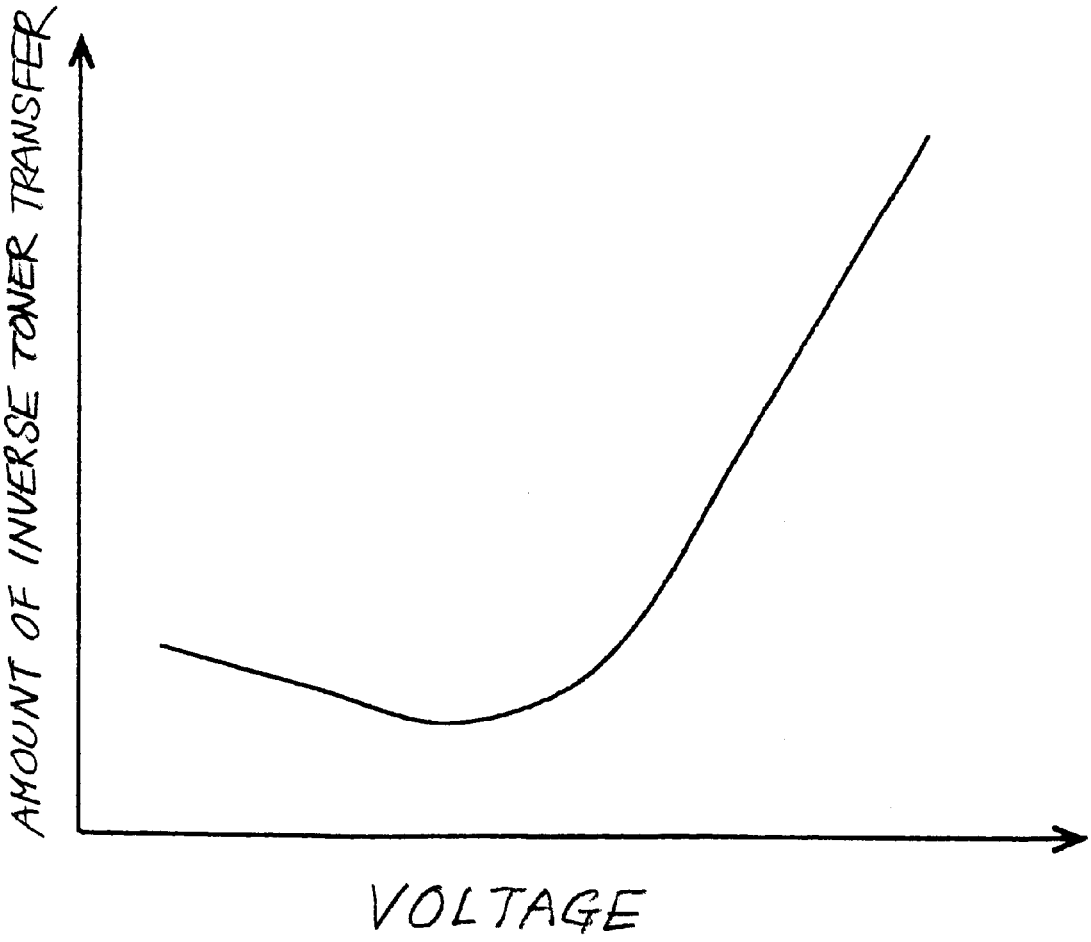
FIG. 2 is a graph showing a relation between inverse toner transfer particular to the full-color system and an image transfer condition.

FIG. 2 shows a relation between the above-described inverse toner transfer and an image transfer condition, i.e., a voltage applied to the image transferring unit. This voltage generates an electric field for causing the toner to migrate from the drum toward the paper sheet. The relation shown in FIG. 2 was determined by a series of experiments. As shown, although a condition that minimizes the inverse toner transfer exists, it is impossible to fully obviate the inverse toner transfer. The curve shown in FIG. 2 suggested that the migration of the toner from the paper sheet toward the drum was dependent on a force other than an electrostatic force. Usually, this force is uncontrollable and makes it impossible to fully obviate the inverse toner transfer.

Therefore, in the following description, some color mixture is assumed to occur in each cleaning unit.

Assume that the toner of different colors collected together from any one of the drums is returned to and stored in the developing unit associated with the drum. Then, filming occurs on a material for charging the toner by friction, i.e., a carrier when a two-ingredient type developer is used or a developing roller when a one-ingredient type developer is used. Further, such toner renders control over toner content impracticable. In practice, however, the amount of upstream toner, or alien toner, to be mixed with downstream toner, or original toner, due to the inverse transfer is so small, it does not bring about any critical trouble if transferred in the same manner as the original toner-stored in the developing unit without staying in the developing unit. It is therefore preferable that the alien toner mixed with the original toner be transferred together with the original toner without staying in the developing unit. In this condition, the color mixture ratio depends on the amount of the alien toner inversely transferred from the paper sheet to the drum. Assume that the amount of the alien toner introduced by the inverse transfer is 5% of the amount of toner developed a latent image by way of example. Then, the final color mixture ratio also saturates at 5%.

To use the alien toner for usual development, the four developing units of the illustrative embodiment are provided with the same specification. Particularly, the developing rollers of the four developing units are implemented by identical members and develop images in identical conditions. This is successful to develop latent images with the alien toner in the same manner as with the original toner.

In the illustrative embodiment, use is made of a two-ingredient type developer, i.e., a toner and carrier mixture. All toner of different colors are chargeable to negative polarity. All binder resins forming the toner are implemented by polyester resin. The mean particle sizes of all the toner of different colors are controlled to 6.5±0.5 $\mu$m. Carrier particles are identical throughout the four colors and effect reversal development. When the full-color system of the illustrative embodiment was operated under the above conditions to form a full-color image, the alien toner did not stay in the developing units despite the toner recycling and insured stable image quality.

When a particular kind of binder resin is used for each toner, a charge series and therefore a frictional charging characteristic differs from one toner to another toner. As a result, the alien toner and original toner each behave in a particular manner and make stable images unachievable.

Further, when each toner has a particle size distribution, the particle size distribution differs between the alien toner and the original toner. As a result, the area over which the toner contacts the charging material, i.e., carrier or developing roller differs between the alien toner and the original toner. It follows that the alien toner and original toner are charged to different amounts from each other. Such toner therefore behave in different manners from each other during development and adversely effect image formation. There were compared two different specific cases, i.e., a first case wherein all toner of different colors had a mean particle size of 6.5±0.5 $\mu$m and a second case wherein the black toner had a mean particle size of 10.0±0.5 $\mu$m while the other toner each had a mean particle size of 6.5±0.5 $\mu$m. In the first case, the alien toner and original toner successfully developed a latent image in the same manner as each other. In the second case, only the toner particles smaller in mean particle size undesirably concentrated on the edges of an image.

Stable image quality can therefore be achieved despite the recycling of the color toner if all the developing units are identical in specification, if all toner of different colors are chargeable to the same polarity and identical in particle size distribution, if the same binder resin is applied to all the toner, and if the same carrier is used in the case of a two-ingredient type developer.

In summary,, it will be seen that the present invention provides a color image forming apparatus having various unprecedented advantages, as enumerated below.

(1) All toner of different colors are chargeable to the same polarity, so that toner mixed together in a cleaning unit can be used for development in the same manner as toner originally existing in a developing unit. The alien toner can therefore be prevented from staying in the developing unit despite that it is recycled, insuring stable image quality.

(2) All toner of different colors are chargeable to the same polarity and implemented by the same binder resin belonging to a preselected charge series and therefore having a preselected frictional charging characteristic. This successfully causes the alien toner and the toner originally stored in the developing unit to behave in the same manner as each other. Consequently, stable image quality is achievable despite the recycling of the toner.

(3) All toner of different colors are chargeable to the same polarity and identical in particle size distribution. In this condition, all toner contact with a toner charging material over the same area and are therefore charged to the same amount. This is also successful to achieve stable image quality despite the recycling of the toner.

(4) All toner of different colors are chargeable to the same polarity while a plurality of developing units each being assigned to a particular color are identical in specification. This is also successful to achieve stable image quality despite the recycling of the toner.

(5) In the case where the developing units each use a two-ingredient type developer, toner of different colors contained in the developers are chargeable to the same polarity while carriers also contained in the developers are identical with each other. This is also successful to achieve stable image quality despite the recycling of the toner.

Various modifications will become possible for those skilled in the art after receiving the teachings of the present disclosure without departing from the scope thereof.

What is claimed is:

1. A color image forming apparatus for sequentially transferring a plurality of toner images, each toner image of said plurality of toner images being formed on each image carrier of a plurality of image carriers, to a recording medium so that a successive toner image of said plurality of toner images is laid on top of a preceding toner image of said plurality of toner images to thereby form a color image, and reusing each developer of a plurality of developers removed from each image carrier of said plurality of image carriers, said color image forming apparatus comprising:

a plurality of developing means, wherein each developing means of said plurality of developing means stores each developer of said plurality of developers implemented by each coloring agent of a plurality of coloring agents for developing a latent image electrostatically formed on each image carrier of said plurality of image carriers with each developer of said plurality of developers;

a plurality of cleaning means, wherein each cleaning means of said plurality of cleaning means removes each developer of said plurality of developers remaining on each image carrier of said plurality of image carriers and collects each developer of said plurality of developers;

a plurality of toner recycling means, wherein each toner recycling means of said plurality of toner recycling means returns each toner of a plurality of toners of different colors collected by each cleaning means of said plurality of cleaning means to each developing means of said plurality of developing means;

wherein each coloring agent of said plurality of coloring agents of each developer of said plurality of developers are chargeable to a same polarity so that an alien color toner collected in each toner of said plurality of toners by each toner recycling means of said plurality of toner recycling means and delivered to each developing means of said plurality of developing means is prevented from staying in each developing means of said plurality of developing means; and wherein each coloring agent of said plurality of coloring agents of each developer of said plurality of developers have a substantially same particle size distribution.

2. The apparatus as claimed in claim 1, wherein each coloring agent of said plurality of coloring agents of each developer of said plurality of developers comprise a same binder resin.

3. The apparatus as claimed in claim 2, wherein said substantially same particle size distribution is a mean particle size of 6.5±0.5 $\mu$m.

4. The apparatus as claimed in claim 3, wherein each developing means of said plurality of developing means have an identical specification.

5. The apparatus as claimed in claim 4, wherein each developing means of said plurality of developing means, which store each developer of said plurality of developers, store a two-ingredient type developer made up of each toner of said plurality of toners and a carrier such that said carrier is a same type of carrier for each of said two-ingredient type developer.

6. The apparatus as claimed in claim 3, wherein each developing means of said plurality of developing means, which store each developer of said plurality of developers, store a two-ingredient type developer made up of each toner of said plurality of toners and a carrier such that said carrier is a same type of carrier for each of said two-ingredient type developer.

7. The apparatus as claimed in claim 2, wherein each developing means of said plurality of developing means have an identical specification.

8. The apparatus as claimed in claim 7, wherein each developing means of said plurality of developing means, which store each developer of said plurality of developers, store a two-ingredient type developer made up of each toner of said plurality of toners and a carrier such that said carrier is a same type of carrier for each of said two-ingredient type developer.

9. The apparatus as claimed in claim 2, wherein each developing means of said plurality of developing means, which store each developer of said plurality of developers, store a two-ingredient type developer made up of each toner of said plurality of toners and a carrier such that said carrier is a same type of carrier for each of said two-ingredient type developer.

10. The apparatus as claimed in claim 1, wherein said substantially same particle size distribution is a mean particle size of 6.5±0.5 $\mu$m.

11. The apparatus as claimed in claim 10, wherein each developing means of said plurality of developing means have an identical specification.

12. The apparatus as claimed in claim 11, wherein each developing means of said plurality of developing means, which store each developer of said plurality of developers, store a two-ingredient type developer made up of each toner of said plurality of toners and a carrier such that said carrier is a same type of carrier for each of said two-ingredient type developer.

13. The apparatus as claimed in claim 10, wherein each developing means of said plurality of developing means, which store each developer of said plurality of developers, store a two-ingredient type developer made up of each toner of said plurality of toners and a carrier such that said carrier is a same type of carrier for each of said two-ingredient type developer.

14. The apparatus as claimed in claim 1, wherein each developing means of said plurality of developing means have an identical specification.

15. The apparatus as claimed in claim 14, wherein each developing means of said plurality of developing means, which store each developer of said plurality of developers, store a two-ingredient type developer made up of each toner of said plurality of toners and a carrier such that said carrier is a same type of carrier for each of said two-ingredient type developer.

16. The apparatus as claimed in claim 1, wherein each developing means of said plurality of developing means, which store each developer of said plurality of developers, store a two-ingredient type developer made up of each toner of said plurality of toners and a carrier such that said carrier is a same type of carrier for each of said two-ingredient type developer.

17. An color image forming apparatus for sequentially transferring a plurality of toner images, each toner image of said plurality of toner images being formed on an image carrier of a plurality of image carriers, to a recording medium one so that a successive toner image of said plurality of toner images is above a preceding toner image of said plurality of toner images to thereby form a color image, and reusing each developer of a plurality of developers removed from each image carrier of said plurality of image carriers, said color image forming apparatus comprising:

a plurality of developing units, wherein each developing unit of said plurality of developing units is configured to store each developer of said plurality of developers implemented by each coloring agent of said plurality of coloring agents for developing a latent image electrostatically formed on each image carrier of said plurality of image carriers with each developer of said plurality of developers;

a plurality of cleaning units, wherein each cleaning units of said plurality of cleaning units is configured to remove each developer of said plurality of developers remaining on each image carrier of said plurality of image carriers and collect each developer of said plurality of developers;

a plurality of toner recycling units, wherein each toner recycling unit of said plurality of toner recycling units is configured to return each toner of a plurality of toners of different colors collected by each cleaning unit of said plurality of cleaning units to each developing unit of said plurality of developing units;

wherein each coloring agent of said plurality of coloring agents of each developer of said plurality of developers are chargeable to a same polarity so that an alien color toner collected in each toner of said plurality of toners by each toner recycling means of said plurality of toner recycling means and delivered to each developing means of said plurality of developing means is prevented from staying in each developing means of said plurality of developing means; and wherein each coloring agent of said plurality of coloring agents of each developer of said plurality of developers have a substantially same particle size distribution.

18. The apparatus as claimed in claim 17, wherein each coloring agent of said plurality of coloring agents of each developer of said plurality of developers comprise a same binder resin.

19. The apparatus as claimed in claim 18, wherein said substantially same particle size distribution is a mean particle size of 6.5±0.5 μm.

20. The apparatus as claimed in claim 19, wherein each developing unit of said plurality of developing units have an identical specification.

21. The apparatus as claimed in claim 20, wherein each developing unit of said plurality of developing units, which store each developer of said plurality of developers, store a two-ingredient type developer made up of each toner of said plurality of toners and a carrier such that said carrier is a same type of carrier for each of said two-ingredient type developer.

22. The apparatus as claimed in claim 19, wherein each developing unit of said plurality of developing units, which store each developer of said plurality of developers, store a two-ingredient type developer made up of each toner of said plurality of toners and a carrier such that said carrier is a same type of carrier for each of said two-ingredient type developer.

23. The apparatus as claimed in claim 18, wherein each developing unit of said plurality of developing units have an identical specification.

24. The apparatus as claimed in claim 23, wherein each developing unit of said plurality of developing units, which store each developer of said plurality of developers, store a two-ingredient type developer made up of each toner of said plurality of toners and a carrier such that said carrier is a same type of carrier for each of said two-ingredient type developer.

25. The apparatus as claimed in claim 18, wherein each developing unit of said plurality of developing units, which store each developer of said plurality of developers, store a two-ingredient type developer made up of each toner of said plurality of toners and a carrier such that said carrier is a same type of carrier for each of said two-ingredient type developer.

26. The apparatus as claimed in claim 17, wherein said substantially same particle size distribution is a mean particle size of 6.5±0.5 μm.

27. The apparatus as claimed in claim 26, wherein each developing unit of said plurality of developing units have an identical specification.

28. The apparatus as claimed in claim 27, wherein each developing unit of said plurality of developing units, which store each developer of said plurality of developers, store a two-ingredient type developer made up of each toner of said plurality of toners and a carrier such that said carrier is a same type of carrier for each of said two-ingredient type developer.

29. The apparatus as claimed in claim 26, wherein each developing unit of said plurality of developing units, which store each developer of said plurality of developers, store a two-ingredient type developer made up of each toner of said plurality of toners and a carrier such that said carrier is a same type of carrier for each of said two-ingredient type developer.

30. The apparatus as claimed in claim 17, wherein each developing unit of said plurality of developing units have an identical specification.

31. The apparatus as claimed in claim 30, wherein each developing unit of said plurality of developing units, which store each developer of said plurality of developers, store a two-ingredient type developer made up of each toner of said plurality of toners and a carrier such that said carrier is a same type of carrier for each of said two-ingredient type developer.

32. The apparatus as claimed in claim 17, wherein each developing unit of said plurality of developing units, which store each developer of said plurality of developers, store a two-ingredient type developer made up of each toner of said plurality of toners and a carrier such that said carrier is a same type of carrier for each of said two-ingredient type developer.

* * * * *